US010916859B2

(12) United States Patent
Fenn et al.

(10) Patent No.: US 10,916,859 B2
(45) Date of Patent: Feb. 9, 2021

(54) INFLATABLE REFLECTOR ANTENNA AND RELATED METHODS

(71) Applicant: Massachusetts Institute of Technology, Cambridge, MA (US)

(72) Inventors: Alan J. Fenn, Wayland, MA (US); Jesse Mills, Fitchburg, MA (US); Frank Robey, Concord, MA (US); James W. Finnell, Jr., Billerica, MA (US); Bakari Hassan, Westwood, CA (US); Sean Crowley, San Luis Obispo, CA (US)

(73) Assignee: Massachusetts Institute of Technology, Cambridge, MA (US)

( * ) Notice: Subject to any disclaimer, the term of this patent is extended or adjusted under 35 U.S.C. 154(b) by 12 days.

(21) Appl. No.: 16/355,052

(22) Filed: Mar. 15, 2019

(65) Prior Publication Data

US 2020/0295469 A1 Sep. 17, 2020

(51) Int. Cl.

| | |
|---|---|
| ***H01Q 15/16*** | (2006.01) |
| ***H01Q 1/28*** | (2006.01) |
| ***H01Q 1/42*** | (2006.01) |

(52) U.S. Cl.

CPC ..... *H01Q 15/163* (2013.01); *H01Q 1/288* (2013.01); *H01Q 1/42* (2013.01)

(58) Field of Classification Search

CPC .... H01Q 15/16; H01Q 15/161; H01Q 15/163; H01Q 1/27; H01Q 1/28; H01Q 1/288

See application file for complete search history.

(56) References Cited

U.S. PATENT DOCUMENTS

| | | | |
|---|---|---|---|
| 2,913,726 | A | 11/1959 | Currie et al. |
| 2,977,596 | A | 3/1961 | Justice |
| 3,095,568 | A | 6/1963 | Aine et al. |
| 3,286,267 | A | 11/1966 | Lutchansky |
| 4,353,071 | A | 10/1982 | Bernstein et al. |

(Continued)

OTHER PUBLICATIONS

[No Author Listed] "Inflatable Antenna Experiment," Wikipedia, Retrieved on Jun. 5, 2019 from <https://en.wikipedia.org/wiki/Inflatable Antenna Experiment>, last edited Dec. 13, 2018 (1 page).

(Continued)

*Primary Examiner* — Jason Crawford
(74) *Attorney, Agent, or Firm* — Nutter McClennen & Fish LLP

(57) ABSTRACT

An inflatable antenna is disclosed herein that is capable of being deployed in space and other suitable environments and configured to improve RF performance and mechanical stability. Related methods for manufacturing and deploying such inflatable antennas are also described. The inflatable antenna can be configured to form a Gregorian dual reflector confocal parabolic antenna system when inflated. Various antenna structures, mechanisms, and manufacturing and deployment techniques are also disclosed herein that improve the precision and accuracy of RF reflective surfaces of the primary and secondary reflectors, confocal alignment of the primary and secondary reflectors, mechanical stability, and/or to improve the range of RF operation. The inflatable antenna can be manufactured and deployed with less complexity and more precision than existing inflatable antennas.

20 Claims, 11 Drawing Sheets

(56) References Cited

U.S. PATENT DOCUMENTS

| | | | | |
|---|---|---|---|---|
| 4,755,819 | A * | 7/1988 | Bernasconi | H01Q 15/163 343/915 |
| 5,793,334 | A | 8/1998 | Anderson et al. | |
| 5,920,294 | A * | 7/1999 | Allen | H01Q 15/163 343/912 |
| 6,219,009 | B1 * | 4/2001 | Shipley | H01Q 1/288 343/912 |
| 6,373,449 | B1 * | 4/2002 | Bokulic | H01Q 1/288 343/840 |
| 7,567,215 | B1 | 7/2009 | All et al. | |
| 8,794,229 | B2 * | 8/2014 | Shi | F24S 23/80 126/684 |
| 2003/0020667 | A1 * | 1/2003 | Essig, Jr. | F24S 25/00 343/832 |
| 2004/0070549 | A1 * | 4/2004 | Thornburgh | H01Q 15/163 343/915 |
| 2004/0207566 | A1 * | 10/2004 | Essig, Jr. | F24S 20/30 343/878 |
| 2004/0222938 | A1 | 11/2004 | Gierow et al. | |
| 2005/0093754 | A1 | 5/2005 | Lyons et al. | |
| 2006/0033674 | A1 * | 2/2006 | Essig, Jr. | F24S 20/80 343/912 |
| 2014/0028532 | A1 * | 1/2014 | Ehrenberg | H01Q 1/1235 343/912 |

OTHER PUBLICATIONS

Babuscia, Alessandra, et. al. "Inflatable Antenna for Cubesat: Extension of the Previously Developed S-band design to the X-band" SPACE Conferences and Exposition. AIAA SPACE 2015 Conference and Exposition, Aug. 31-Sep. 2, Sep 2015 (13 pages).

Chahat, Nacer, "CubeSat Deployable Ka-Band Mesh Reflector Antenna Development for Earth Science Missions", IEEE Transactions on Antennas and Propagation, vol, 64, No. 6, Jun. 2016 (11 pages).

Chu, J., Inflatable antennae could give CubeSats greater reach, on the web at <http://news.mit.edu/2013/inflatable-antennae-could-give-cubesats-greater-reach-0906>, Sep. 6, 2013 (4 pages).

Steiner, Mark, et al. "Preliminary Mission Report: Spartan 207/ Inflatable Antenna Experiment", NASA GSFC. Feb. 14, 1997(12 pages).

International Search Report and Written Opinion for Application No. PCT/US19/22532 dated Sep. 4, 2019 (14 Pages).

* cited by examiner

INFLATABLE REFLECTOR ANTENNA AND RELATED METHODS

GOVERNMENT RIGHTS

This invention was made with Government support under Grant No. FA8702-15-D-0001 awarded by the U.S. Air Force. The Government has certain rights in the invention.

FIELD

The present disclosure relates generally to inflatable antennas, and more particularly to inflatable reflector antennas deployable in space and other suitable environments with improved radio frequency (RF) performance, and related methods for manufacturing and deploying such inflatable reflector antennas.

BACKGROUND

Traditional space deployable antennas generally employ hinges and latches that stretch a metallic mesh or membrane to form a reflector antenna surface with good precision, surface accuracy, and high reliability of deployment. However, stowed volume restrictions for payloads in small satellites and other spacecraft (e.g., CubeSat) can limit the use of traditional antennas to those having small deployed aperture areas (e.g., about 0.5 meters in diameter). For many applications, such as RF sensing and communications, an order-of-magnitude improvement or more in deployed aperture area for the same volume can be required.

Inflatable antennas have been studied as a possible replacement to traditional space deployable antenna, but have generally fallen short of RF performance requirements. Some challenges associated with existing inflatable antenna designs can include surface imperfections, errors in focal alignment, mechanical instability, and/or limited operation at low frequencies (e.g., S-band and lower). Accordingly, there is a need for improved inflatable antennas capable of being deployed in space or other suitable environments with improved radio frequency (RF) performance.

SUMMARY

The present disclosure describes various embodiments of an inflatable antenna capable of being deployed in space and/or other suitable environments and configured to improve RF performance and mechanical stability. Related methods for manufacturing and deploying such inflatable antennas are also described. In some embodiments, the inflatable antenna can be configured to form a Gregorian dual reflector confocal parabolic antenna when inflated. Various antenna structures, mechanisms, and/or manufacturing/deployment techniques are also disclosed herein to improve the precision and accuracy of RF reflective surfaces of the primary and secondary reflectors, confocal alignment of the primary and secondary reflectors, mechanical stability, and/or to improve the range of RF operation to higher frequencies (e.g., C band, X band, Ku band, etc.). In some embodiments, the inflatable antenna can be manufactured and deployed with less complexity and more precision than existing inflatable antennas.

One exemplary embodiment includes an inflatable antenna having a first inflatable chamber that includes a radio frequency (RF) reflective section configured to form a first reflector having a concave shape when the first inflatable chamber is inflated; a second inflatable chamber disposed within the first inflatable chamber and including an RF reflective section configured to form a second reflector having one of a concave shape and a convex shape that opposes the first reflector when the second inflatable chamber is inflated; and a third inflatable chamber coupled to the first inflatable chamber and configured to define an outer perimeter of the inflatable antenna when the third inflatable chamber is inflated. In some embodiments, the inflatable antenna can further include an antenna feed disposed at an end of the second inflatable chamber at or near a base of the first reflector and configured to transmit or receive signals through the second reflector. Each of the first reflector and the second reflect can have a paraboloid shape.

In some embodiments, the first inflatable chamber can include a first RF transparent section disposed around the RF reflective section to avoid surface distortions in the first reflector when the first inflatable chamber is inflated. Further, the first inflatable chamber can include a second RF transparent section configured to form an RF transparent canopy that is substantially symmetric to the first reflector when the first inflatable chamber is inflated. In some embodiments, the second inflatable chamber can include an RF transparent section disposed around the RF reflective section to avoid surface distortions in the second reflector when the second inflatable chamber is inflated.

In some embodiments, the first, second, and third inflatable chambers can be configured to be separately inflated to different pressures selected to avoid surface distortions in the first reflector and the second reflector. For example, in certain embodiments, one or more of the first, second, and third inflatable chambers can be configured to be separately inflated such that a stress applied to each of the one or more inflatable chambers is at least about 10% of a yield point for a material of the chamber.

In some embodiments, the second reflector of the second inflatable chamber can be configured to be confocally aligned with the first reflector of the first inflatable chamber to form a Gregorian dual-reflector antenna when the first and second inflatable chambers are inflated. In some embodiments, the second inflatable chamber can be configured to have an adjustable height to facilitate confocal alignment of the first reflector and the second reflector when the first and second inflatable chambers are inflated. In some embodiments, an angular orientation of the first inflatable chamber can be independently adjustable in one or more of an azimuth direction and an elevation direction to facilitate confocal alignment of the first reflector to the second reflector of the second inflatable chamber when the first and second inflatable chambers are inflated. Further, a winch having multiple cables can be coupled to the third inflatable chamber and configured to adjust the angular orientation of the first inflatable chamber in one or more of the azimuth direction and the elevation direction by respectively winding up or winding out the cables.

In some embodiments, the third inflatable chamber can be configured to form a torus when inflated. The second inflatable chamber can be configured to form a substantially cylindrical tube having a closed end portion that forms the second reflector when the second inflatable chamber is inflated. The second inflatable chamber can be disposed within a volume defined between the first reflector and the RF transparent canopy when the first inflatable chamber is inflated. In some embodiments, a diameter of the first inflatable chamber can be greater than a diameter of the second inflatable chamber. In some embodiments, a surface of one or more of the first inflatable chamber, the second inflatable chamber, and the third inflatable chamber can be coated with a ultraviolet (UV) curable substance that hardens when exposed to UV light. In some embodiments, one or more of the first inflatable chamber, the second inflatable chamber, and the third inflatable chamber can be made of a polyester material or other suitable thin film material.

Another exemplary embodiment includes an antenna having a primary reflector disposed on a surface of a first inflatable chamber; a secondary reflector that opposes the primary reflector and is disposed on a surface of a second inflatable chamber, the second inflatable chamber being disposed within the first inflatable chamber; and a third inflatable chamber coupled to the first inflatable chamber and defining an outer perimeter of the antenna. In some embodiments, the antenna can further include an antenna feed disposed at an end of the second inflatable chamber at or near a base of the primary reflector and configured to transmit or receive signals through the secondary reflector. In some embodiments, the primary reflector can have a paraboloid shape, a spherical shape, or a custom shape including offset reflector geometries. The primary reflector can have a concave shape. The secondary reflector can have a paraboloid shape, an ellipsoid shape, a hyperboloid shape, or a custom shape including offset geometries. The secondary reflector can be concave or convex facing the primary reflector. In some embodiments, an RF reflective surface of the primary reflector can be substantially devoid of wrinkles. In some embodiments, one or more of the first, second, and third inflatable chambers can be separately inflated such that a stress applied to each of the one or more inflatable chambers is at least about 10% of a yield point for a material of the chamber.

Another exemplary embodiment includes a method of using an inflatable antenna that includes releasing an inflatable antenna having multiple inflatable chambers from a storage of a spacecraft body while in space and inflating the inflatable chambers of the inflatable antenna to different pressures. A first inflatable chamber having an RF reflective section is inflated to a first pressure that causes the RF reflective surface to form a first reflector having a concave shape; a second inflatable chamber having a RF reflective section and disposed within the first inflatable chamber is inflated to a second pressure that causes the RF reflective section to form a second reflector having one of a concave shape and a convex shape that opposes the first reflector; and a third inflatable chamber is inflated to a third pressure that causes the third inflatable chamber to form an outer perimeter of the inflatable antenna.

In some embodiments, inflating the multiple inflatable chambers of the inflatable antenna to different pressures can include heating a liquid source for each chamber to a respective temperature to generate an inflation gas and injecting the inflation gas from each heated liquid source into a respective one of the inflatable chambers to inflate the chamber to a target pressure. In some embodiments, inflating the inflatable chambers of the inflatable antenna to different pressures can include separately inflating one or more of the first, second, and third inflatable chambers such that a stress applied to each of the one or more inflatable chambers is at least about 10% of a yield point for a material of the chamber. In some embodiments, the inflation gas can be generated by heating one or more sublimation powders. In some embodiments, the method can further include adjusting an angular orientation of the first inflatable chamber in one or more of an elevation direction and an azimuth direction to facilitate confocal alignment of the first reflector to the second reflector using a winch mechanism that is disposed in the spacecraft body and coupled to the third inflatable chamber by cables. Further, the method can include determining the angular orientation of the first inflatable chamber in one or more of the elevation direction and the azimuth direction using an optical sensor disposed on the spacecraft body to measure a distance between the optical sensor and the first reflector.

In some embodiments, the method can further include detecting an RF signal error received by a phased antenna array feed from the second reflector of the inflatable antenna and correcting the RF signal error by adjusting one or more analog or digital phase-shift weights of the phased antenna array feed.

Another exemplary embodiment includes a method of manufacturing an inflatable antenna that includes assembling a first portion and a second portion of a first inflatable chamber, the first portion including a RF reflective section configured to form a first reflector having a concave shape and the second portion including an RF transparent section configured to form an RF transparent canopy that is substantially symmetric to the first reflector when the first inflatable chamber is inflated. A first portion and a second portion of a second inflatable chamber is assembled with the first portion being configured to house an antenna feed and the second portion including an RF reflective section configured to form a second reflector having one of a concave shape and a convex shape that opposes the first reflector when the second inflatable chamber is inflated. The method further includes assembling the second inflatable chamber by coupling the first portion and the second portion of the second inflatable chamber; coupling the second inflatable chamber to the first portion of the first inflatable chamber such that the antenna feed is at or near a vertex of the first reflector; assembling a third inflatable chamber having a toroidal shape; and assembling the first inflatable chamber by coupling the first portion and the second portion of the first inflatable chamber to the third inflatable chamber such that the third inflatable chamber forms an outer perimeter of the inflatable antenna and the first reflector and the RF transparent canopy are symmetrically disposed inside the perimeter when the first, second and third inflatable chambers are inflated. In some embodiments, each of the first reflector and the second reflector can have a paraboloid shape.

In some embodiments, the method can further include inflating the first, second, and third inflatable chambers to different pressures to form the first reflector, the second reflector, and the outer perimeter of the inflatable antenna and heating one or more portions of the first inflatable chamber to remove surface distortions in the first reflector. In some embodiments, the method can further include inflating the second inflatable chamber to form the second reflector and heating one or more portions of the second inflatable chamber to remove surface distortions in the second reflector.

In some embodiments, assembling the first portion and the second portion of the first inflatable chamber can include assembling each of the first portion and the second portion of the first inflatable chamber by joining multiple gores placed on a three-dimensional mandrel having a substantially parabolic shape. In some embodiments, assembling the second portion of the second inflatable chamber can include joining a multiple gores placed on a three-dimensional mandrel having a substantially parabolic shape.

BRIEF DESCRIPTION OF THE DRAWINGS

The accompanying drawings, which are incorporated herein and constitute part of this specification, illustrate exemplary embodiments, and together with the general description given above and the detailed description given below, serve to explain the features of the various embodiments.

DETAILED DESCRIPTION

Figure 1A:
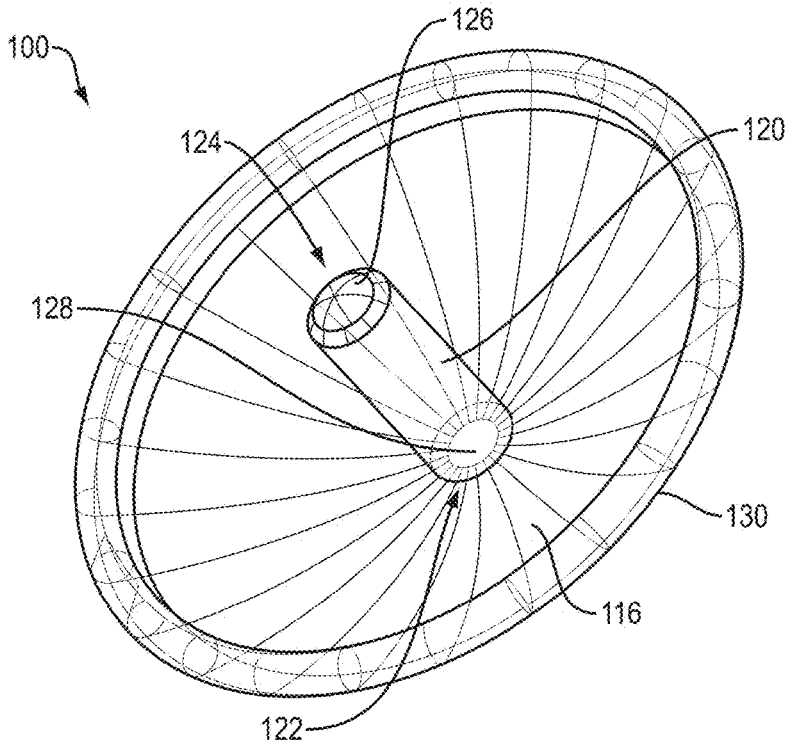
FIG. 1A is a perspective view of an exemplary embodiment of an inflatable antenna in an inflated state.

Certain exemplary embodiments will now be described to provide an overall understanding of the principles of the structure, function, manufacture, and use of the systems, devices, and methods disclosed herein. One or more examples of these embodiments are illustrated in the accompanying drawings. Those skilled in the art will understand that the systems, devices, and methods specifically described herein and illustrated in the accompanying drawings are non-limiting exemplary embodiments and that the scope of the present disclosure is defined solely by the claims. The features illustrated or described in connection with one exemplary embodiment may be combined with the features of other embodiments. Such modifications and variations are intended to be included within the scope of the present disclosure. In the present disclosure, like-numbered and/or like-named components of various embodiments generally have similar features when those components are of a similar nature and/or serve a similar purpose, unless stated otherwise. A person skilled in the art, in view of the present disclosure, will understand various instances in which like-numbered components across various figures are akin. Further, although terms such as "first" and "second" are used to describe various aspects of a component, e.g., a first end and a second end, such use is not indicative that one component comes before the other. Use of terms of this nature may be used to distinguish two similar components or features and/or different sections and/or sides of the same component, and often such first and second components can be used interchangeably.

The present disclosure describes various embodiments of inflatable antennas capable of being deployed in space and/or other suitable environments and configured to improve radio frequency (RF) performance and mechanical stability. Related methods for manufacturing and deploying such inflatable antennas are also described. In some embodiments, the inflatable antenna can be configured to form a Gregorian dual reflector confocal parabolic antenna when inflated. Various antenna structures, mechanisms, and/or manufacturing/deployment techniques are also disclosed herein to improve the precision and accuracy of RF reflective surfaces of the primary and secondary reflectors, confocal alignment of the primary and secondary reflectors, mechanical stability, and/or to improve the range of RF operation to higher frequencies (e.g., Cu band, X band, Ku band, etc.). In some embodiments, the inflatable antenna can be manufactured and deployed with less complexity and more precision than existing inflatable antennas.

Although the various structures, mechanisms, and techniques disclosed herein are described in connection with the manufacture and deployment of a Gregorian dual reflector confocal parabolic antenna, one of ordinary skill in the art will recognize that embodiments of such structures, mechanisms, and/or techniques can be tailored to manufacture and/or deploy other types of inflatable antennas. For example, in some embodiments, the inflatable antenna can be configured to form other antenna types including, but not limited to Cassegrain dual reflector antenna, prime focus single reflector antenna, and other shaped reflector antenna systems. The feed antenna can be any one of a planar array antenna, a phased array antenna, a horn antenna, a spiral antenna, a helix antenna, a dipole antenna, a log periodic antenna, a patch antenna, or other directional antenna.

Figure 1B:
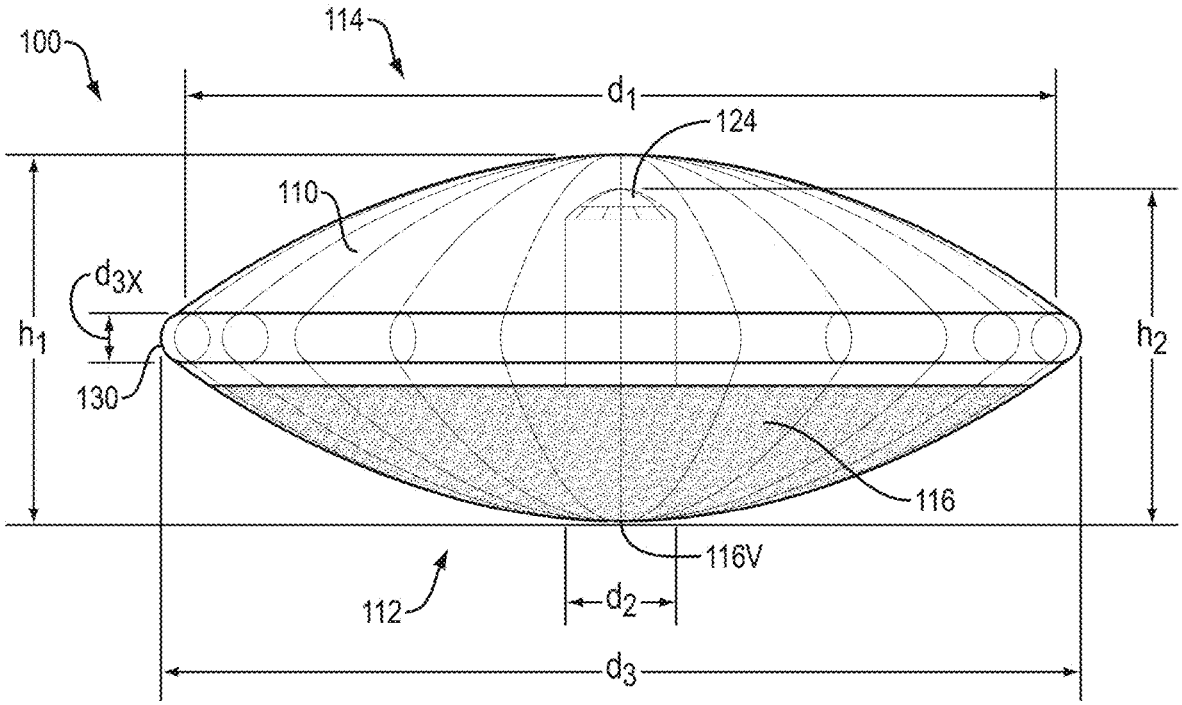
FIG. 1B is a side view of the inflatable antenna of FIG. 1A.

FIGS. 1A and 1B are illustrations of one exemplary embodiment of an inflatable antenna 100, the antenna being in an inflated state. As shown in the illustrated embodiment, the inflatable antenna 100 can be inflated to form a Gregorian type, dual reflector parabolic antenna. Gregorian type dual reflector parabolic antennas can be used to provide high gain and/or directivity for, without limitation, point-to-point communications; satellite, balloon, and/or drone communications; and radar, radio astronomy, or other sensing applications. The inflatable antenna 100 can be configured to include multiple inflatable chambers. For example, as shown in the illustrated embodiment, the inflatable antenna 100 can include a primary reflector chamber 110, a secondary reflector chamber 120, and an outer chamber 130. Although the inflatable antenna 100 as shown includes three inflatable chambers, other embodiments of the inflatable antenna can include more or less than three inflatable chambers.

The primary reflector chamber 110 can include a reflector side 112 and a canopy side 114. The reflector side 112 and the canopy side 114 of the primary reflector chamber 110 can be configured to symmetrically oppose each other to define a spatial interior volume of the chamber 110. The reflector side 112 of the primary reflector chamber 110 can be configured to form a primary parabolic reflector 116 of the antenna. The opposing canopy side 114 of the chamber can be configured to form an RF transparent canopy symmetric to the reflector side 112. In some embodiments, the reflector side 112 and the canopy side 114 of the chamber can be configured such that each forms a circular paraboloid or a substantially circular paraboloid. A person skilled in the art will recognize other shapes are possible, including but not limited to paraboloid, a spherical shape, or a custom shape including offset reflector geometries, although such a person will further recognize there may be trade-offs between the shape and performance. A paraboloid can be defined as a parabola revolved about a central axis. A spherical shape can be defined as an arc of a circle revolved about a central axis.

The canopy side 114 of the primary reflector chamber 110 can be made of an RF transparent material that allows RF signals to enter and exit the chamber, such as but not limited to Dupont® Melinex® 377 polyester film. In some embodiments, the primary reflector 116 can be fabricated by coating or otherwise depositing an RF reflective material layer on an interior section of the reflector side 112 of the chamber to form an RF reflective surface. In some embodiments, the reflector side 112 of the chamber 110, or a portion thereof, can be made of an RF reflective material that forms the primary reflector 116 when the chamber 110 is inflated. The RF reflective material and/or material layer can be a metallic film or substrate, including but not limited to aluminum or an aluminum-based film or substrate. In some embodiments, the primary reflector chamber 110 can have a maximum diameter $d_1$ approximately in the range of about 1 meter to about 10 meters.

The secondary reflector chamber 120 can be configured to form a cylindrical or substantially cylindrical closed tube disposed within the primary reflector chamber 110. The secondary reflector chamber 120 can have a first end 122 and a second end 124. The first end 122 of the chamber can be coupled to the reflector side 112 of the primary reflector chamber 110. For example, in some embodiments, the first end 122 can be coupled at or near the vertex 116V of the primary reflector 116. The free second end 124 of the chamber 110 can be configured to form a secondary parabolic reflector 126 that opposes the primary parabolic reflector 116 of the primary reflector chamber 110. In some embodiments, the second end 124 of the chamber can be configured to form a paraboloid or a substantially paraboloid. A person skilled in the art will recognize other shapes are possible for the secondary reflector chamber 120, or aspects thereof (e.g., the first and second ends 122, 124), depending, at least in part, on the sizes, shapes, and configurations of other components of the antenna 100 and the intended use of the antenna 100, among other factors. Other possible shapes for the second end 124 include but are not limited to hyperboloid, ellipsoid, or other custom shapes. The second end 124 can be concave or convex facing the primary reflector 116.

In some embodiments, the secondary reflector chamber 120 can have a diameter $d_2$ to prohibit, or at least reduce, the formation of wrinkles in the secondary reflective surface 126 and a maximum height $h_2$ less than the total height $h_1$ of the primary chamber 110. In some embodiments, the diameter d2 can be dependent on the size of an RF antenna feed 128 disposed within the chamber 120.

An RF antenna feed 128 can be disposed or at least partially disposed at the first end 122 within a spatial interior volume of the secondary reflector chamber 120. As discussed in more detail below with respect to FIG. 2, the RF antenna feed 128 can be configured to transmit, receive, or both transmit and receive RF signals through the RF reflective surfaces of the primary and secondary reflectors 116, 126. In some embodiments, the RF antenna feed 128 can be a phased array RF antenna feed.

In some embodiments, the secondary reflector 126 can be fabricated by coating or otherwise depositing an RF reflective material layer on an interior section of the second end 122 of the chamber to form an RF reflective surface. In some embodiments, a portion of the second end 122 of the chamber can be made of an RF reflective material that forms the secondary reflector 126 when the chamber 120 is inflated. In some embodiments, the RF reflective material and/or material layer can be a metallic film or substrate, including but not limited to aluminum or an aluminum-based film or substrate. The non-reflective portions of the secondary reflector chamber 120 can be made of an RF transparent material that allows RF signals to enter and exit the chamber, such as but not limited to Dupont® Melinex® 377 polyester film.

The outer chamber 130 can be configured to form a toroid (e.g., a torus chamber) or other suitable shape that provides a stiff mechanical boundary to define the outer perimeter of the inflatable antenna 100. The outer chamber 130 can be coupled to the primary reflector chamber 110 at an interface between the reflector side 112 and the canopy side 114 of the chamber 110. In some embodiments, the reflector side 112 and the canopy side 114 of the primary reflector chamber 110 can be attached to the outer chamber 130 using tape or other suitable adhesive. In other embodiments, the antenna 100 can be manufactured in a manner such that the two separate chambers 110 and 130 are separate but conjoined on their outer walls in some manner. The outer chamber 130 can be used to maintain a desired shape and surface quality of the primary reflector 116 when the antenna is fully inflated.

In some embodiments, the torus chamber 130 can have an outer diameter $d_3$ greater than the diameter $d_1$ of the primary chamber 110 to prohibit, or at least reduce, the development of wrinkles in the primary reflective side 116. The torus chamber 130 can have a cross sectional diameter $d_{3X}$ sized to prevent buckling under inflation pressure required to form primary reflective side 112.

Figure 2:
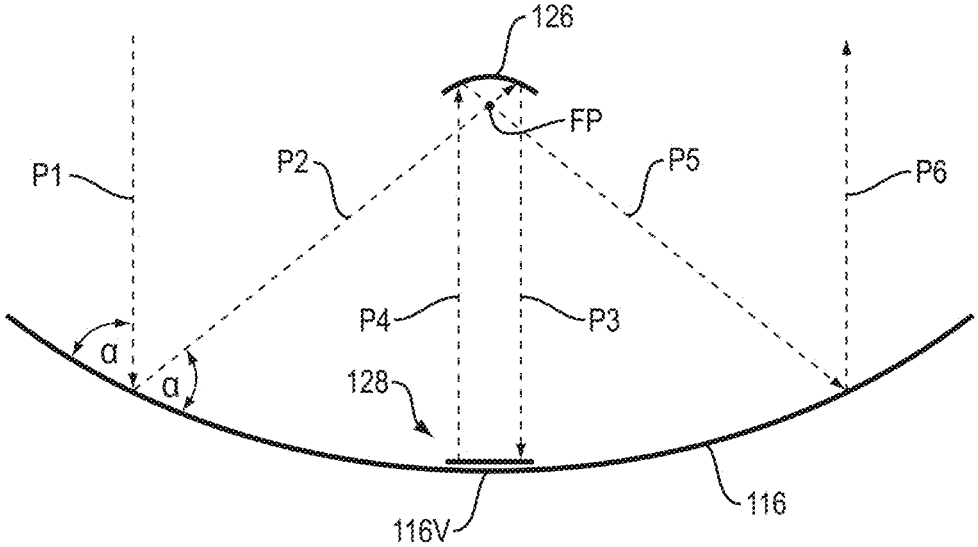
FIG. 2 is a schematic illustration of exemplary RF receive and transmit operations using the inflatable antenna of FIGS. 1A and 1B.

FIG. 2 is a schematic illustration of exemplary RF receive and transmit operations using the inflatable antenna 100 of FIGS. 1A and 1B. As shown in the illustrated embodiment, when the chambers 110, 120, and 130 of the antenna 100 are inflated, the secondary parabolic reflector 126 can be configured to oppose the primary parabolic reflector 116 such that the reflectors share a common focal point FP. The RF antenna feed 128 can be disposed at or near the vertex 116V of the primary reflector 116. As discussed in more detail below with respect to FIGS. 6A-6C and 7A-7D, in some embodiments, adjustments can be made to various aspects of the antenna 100, including but not limited to one or more of the height of the secondary reflector 126 and the angular orientation of the primary reflector 116 to correct any deviation in confocal alignment of the reflectors.

With respect to receive operations, an incoming RF signal, e.g., transmitted from a ground station or other remote transceiver (not shown), can enter the primary reflector chamber 110 through the RF transparent canopy 114 along a path P1 towards the primary parabolic reflector 116. The incoming signal reflects off the RF reflective surface of the primary reflector 116 at an angle α along a path P2, through the common focal point FP, to the secondary parabolic reflector 126. The incoming signal, in turn, reflects off the RF reflective surface of the secondary reflector 126, as shown along a path P3, substantially normal to the reflective surface and towards the RF antenna feed 128 for reception and further processing.

With respect to transmit operations, the RF antenna feed 128 can transmit an outgoing RF signal along a path P4 towards the secondary reflector 126. The outgoing signal reflects off the RF reflective surface of the secondary reflector 126 at an angle along a path P5, through the common focal point FP, to the primary reflector 116. The outgoing signal, in turn, reflects off the RF reflective surface of the primary reflector 116, as shown along a path P6, substantially normal to the reflective surface, and thereby exits the primary reflector chamber 110 via the canopy 114 for transmission to a ground station or other remote transceiver (not shown).

Figure 3:
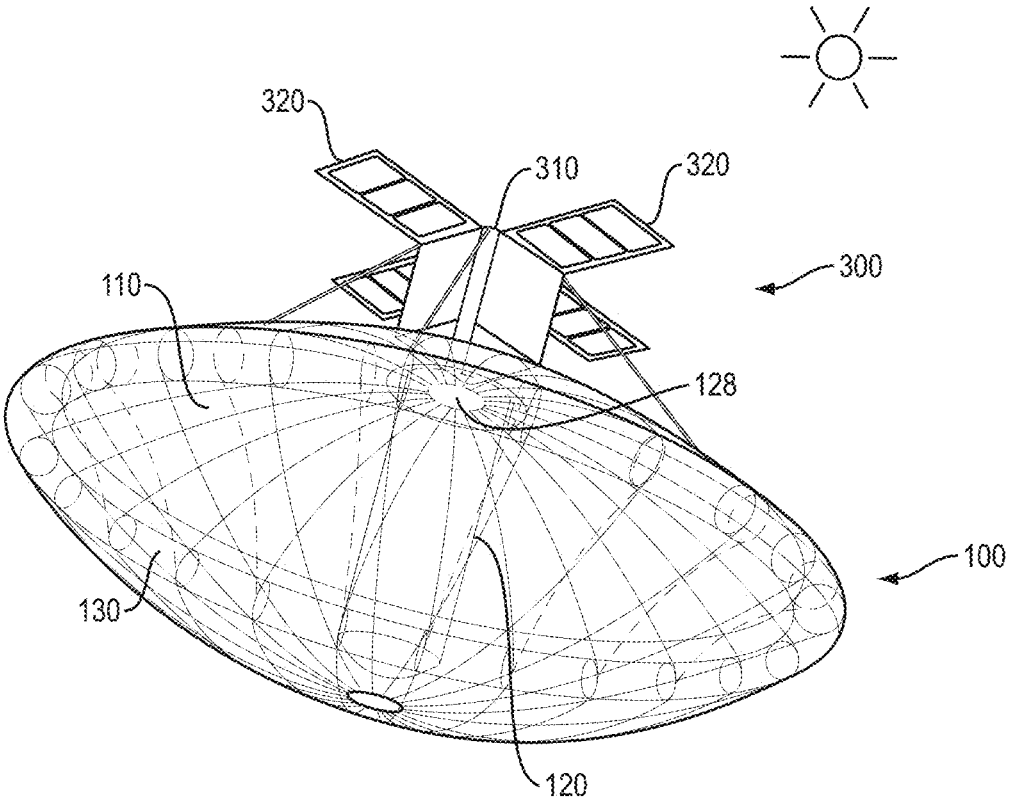
FIG. 3 is a perspective view of the inflated antenna of FIGS. 1A and 1B deployed from a spacecraft body, as shown a satellite.

FIG. 3 is a schematic illustration of the inflatable antenna 100 of FIGS. 1A and 1B deployed from a spacecraft body, as shown a satellite 300. As shown in the illustrated embodiment, the inflatable antenna 100 can be released while in space from a storage space of the satellite 300 and deployed distally from the satellite 300 such that the satellite is disposed between the antenna 100 and the sun. By deploying the inflatable antenna 100 distally from the satellite 300, the satellite body 310 and other satellite components (e.g., solar panels 320) can be prevented from blocking RF communication path(s) between the antenna 100 and a ground station or other remote transceiver (not shown). Deploying the inflatable antenna 100 distally from the satellite 300 can also prevent the antenna from blocking solar energy to the satellite 300, thereby enabling the use of solar panels 320 or other solar sensitive components for battery recharging. Deploying the inflatable antenna 100 distally from the satellite 300 can also allow the RF antenna feed 128 to be disposed close the satellite body 310 and thereby minimize packaging and deployment complexity.

Wrinkles and other surface imperfections in the RF reflective surfaces of the primary and secondary reflectors 116, 126 can potentially have a negative impact on the RF performance of the antenna. Wrinkles can develop at locations that correspond to changes in curvature of the inflated antenna 100. For example, wrinkles can form where the primary reflector chamber 110 attaches to the torus chamber 130, e.g., as shown approximately at location $W_1$ in FIG. 4A. Wrinkles can also form where the cylindrical shape of the secondary reflector chamber 120 transitions to a paraboloid shape, e.g., as shown approximately at location $W_2$ in FIG. 4B. Thus, in some embodiments, the inflatable antenna 100 can be configured such that wrinkled surfaces within the primary and secondary reflector chambers 110, 120 can be reduced, minimized, or eliminated from the RF reflective surface areas of the primary and secondary reflectors 116, 126.

Figure 4A:
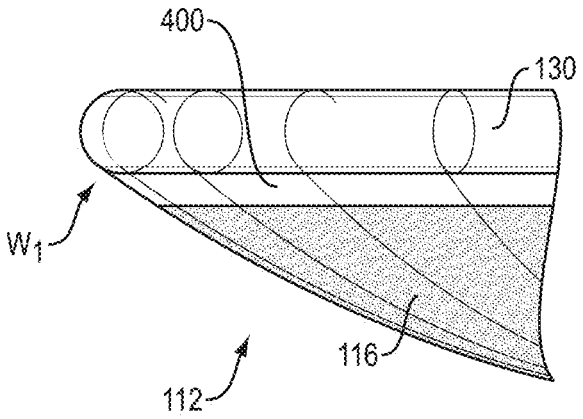
FIG. 4A is a side view of an RF transparent section on a reflector side of a primary reflector chamber of the space satellite of FIGS. 1A and 1B.

FIG. 4A provides a more detailed view of an RF transparent section 400 on the reflector side 112 of the primary reflector chamber 110. In some embodiments, the RF transparent section 400 can be interposed at an interface between the primary reflector 116 and the torus chamber 130. The RF transparent section 400 can be sized to encompass wrinkled surface areas (or surface areas likely to develop wrinkles) between the primary reflector 116 disposed on the reflector side 112 of the primary reflector chamber 110 and the torus chamber 130 after inflation. Thus, the RF transparent section 400 can define an outer edge of the primary reflector 116 and thereby can help reduce, minimize, and/or eliminate wrinkled surface areas from within the reflective surface area of the reflector. In some embodiments, the RF transparent section 400 can form an annular band of RF transparent material along the outer edge of the primary reflector 116. Incoming and outgoing RF signals can simply pass through the RF transparent section to avoid signal distortion and thereby prevent degraded antenna performance.

Figure 4B:
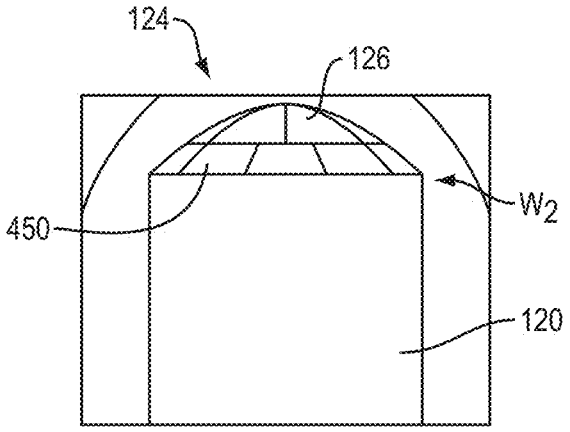
FIG. 4B is a side view of an RF transparent section on a reflector side of a secondary reflector chamber of the space satellite of FIGS. 1A and 1B.

FIG. 4B provides a more detailed view of an RF transparent section 450 on the reflector side 124 of the secondary reflector chamber 120. In some embodiments, the RF transparent section 450 can be disposed about the secondary reflector 126 at the free end or reflector side 124 of the secondary reflector chamber 120. The RF transparent section 450 can be sized to encompass wrinkled surface areas (or surface areas likely to develop wrinkles) about the secondary reflector 126 at or adjacent to the free end 124 of the secondary reflector chamber after inflation. Thus, the RF transparent section 450 can define an outer edge of the secondary reflector 126 and can help reduce, minimize, and/or eliminate wrinkled surface areas from developing within the reflective surface area of the reflector. In some embodiments, the RF transparent section 450 can form an annular band of RF transparent material along the outer edge of the RF reflective surface of the secondary reflector 126. Incoming and outgoing RF signals can simply pass through the RF transparent section 450 to avoid signal distortion and thereby prevent degraded antenna performance.

In some embodiments, where the RF reflective surface of the primary or secondary reflector is fabricated by coating an RF reflective material layer on an RF transparent substrate, the RF transparent section 400 or 450 can be an exposed portion of the RF transparent substrate. In some embodiments, where the RF reflective surface of the reflector is made of an RF reflective material substrate, the RF transparent section 400 or 450 can be fabricated by appending an annular band of an RF transparent material substrate along an outer edge of the RF reflective material substrate.

Wrinkles and other surface imperfections can also develop within the RF reflective surface area of the primary and secondary reflectors 116, 126 of the inflatable antenna 100. Such wrinkles can develop, for example, from folding or imperfect fabrication of the primary and secondary inflatable chambers 110, 120. Thus, in some embodiments, when the inflatable antenna 100 is released and deployed in space from storage of a satellite 300 or other spacecraft body, each chamber of the inflatable antenna 100 can be inflated to a desired pressure that removes, minimizes, and/or reduces wrinkles from the RF reflective surface areas of the primary and secondary reflectors 116, 126. However, the desired pressure for inflating one chamber can be different than the desired pressure for one or more of the other chambers. Thus, as discussed below with respect to FIG. 5, the inflatable antenna 100 can be configured to separately inflate each of the chambers 110, 120, and 130 to a pressure targeted to remove, minimize and/or reduce wrinkles or other imperfections.

Figure 5:
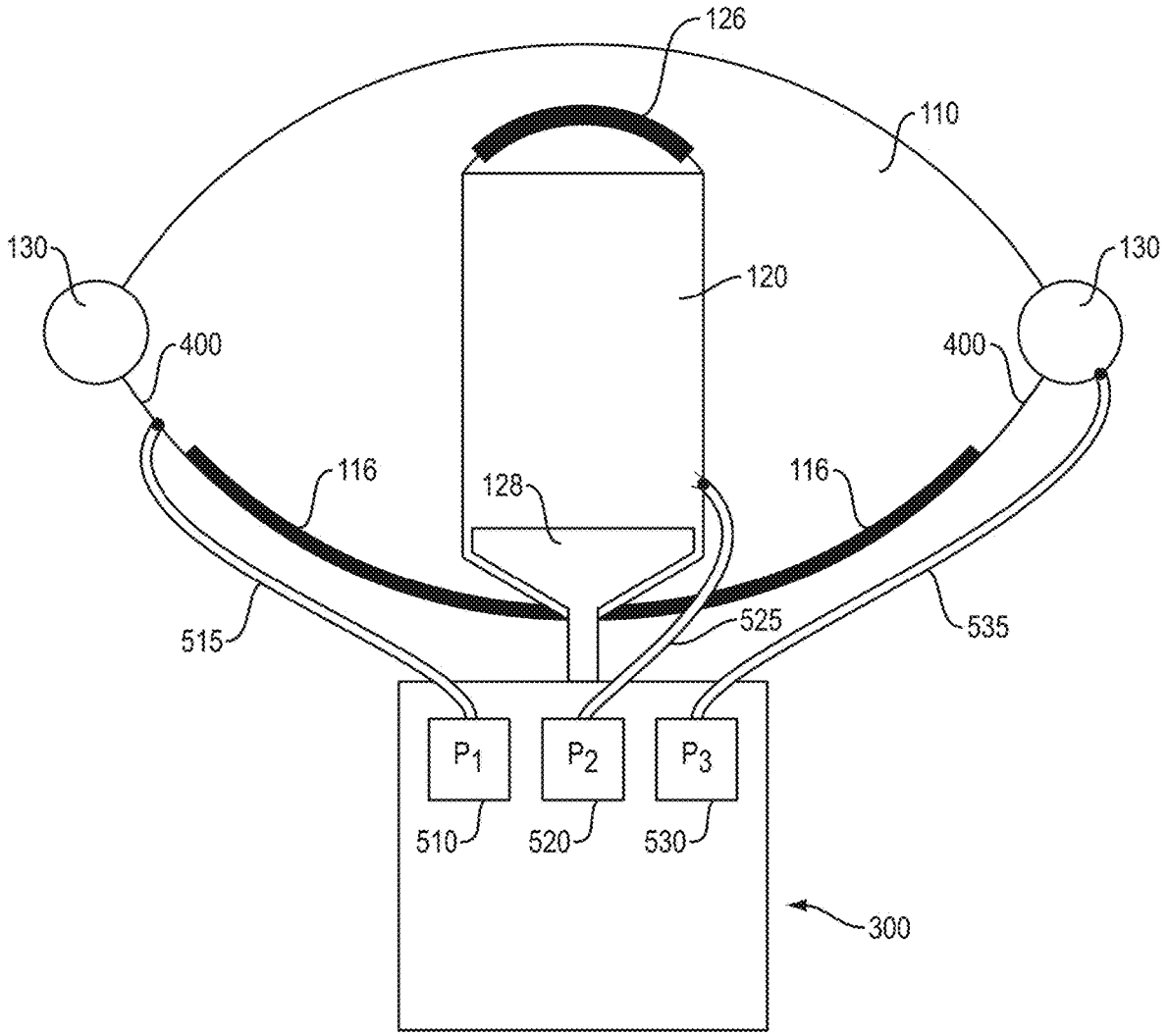
FIG. 5 is a schematic side view of an exemplary embodiment of an inflation mechanism that can be used to separately inflate separate chambers of the inflatable antenna of FIGS. 1A and 1B.

FIG. 5 is a schematic illustration of an exemplary embodiment of an inflation mechanism for separately inflating the chambers 110, 120, and 130 of the inflatable antenna of FIGS. 1A and 1B. Each chamber can be inflated to a target pressure that causes the chamber to stretch, and thereby remove or reduce surface wrinkles therein and/or improve the mechanical stability of the inflated chamber to maintain its shape. For example, when the inflatable antenna 100 is released and deployed in space from storage of a satellite 300 or other spacecraft body, the primary reflector chamber 110 can be inflated to a first target pressure $P_1$ that stretches the chamber to remove or reduce wrinkles within the RF reflective surface area of the primary reflector 116. The secondary reflector chamber 120 can be inflated to a second target pressure P2 that stretches the chamber to remove or reduce wrinkles within the RF reflective surface area of the secondary reflector 126. The torus chamber 130 can be inflated to a third target pressure P3 so that the chamber forms a stiff mechanical boundary or perimeter of the antenna.

In some embodiments, one or more of the chambers can be inflated to a different target pressure. For example, the respective pressures to which the inflatable chambers are inflated can be selected to apply a stress that is a significant fraction of the yield point for the material of the chamber, such that the elasticity of the thin films can be utilized to eliminate surface wrinkles that result from folding or imperfect fabrication (such as tape seaming and alignments). A person skilled in the art will understand that the yield point of a material is a point on a stress-strain curve that indicates the limit of elastic behavior of the material and the point at which nonlinear deformation of the material begins. A material deforms elastically in response to application of a stress that is less than its yield point and returns to its original shape when the applied stress is removed. In some embodiments, the inflation pressure of each chamber, or at least one chamber, can be selected to apply a stress that is at least about 10% of the yield point for the chosen material of that chamber at room temperature. A person skilled in the art will recognize that the ideal or target pressure for each chamber, as well as an upper limit of a stress, can vary depending, at least in part, on geometry and deployment conditions, such as the sizes, shapes, dimensions, and/or configurations of the chamber, among other factors.

In some embodiments, each of the separately inflatable chambers 110, 120, and 130 can be coupled to a respective inflation source, also referred to as liquid sources, 510, 520, and 530 housed within the satellite 300 or other spacecraft through a flexible conduit 515, 525, and 535. Thus, when the inflatable antenna 100 is released and deployed in space from storage of a satellite 300 or other spacecraft body, each inflation source can generate an inflation gas that can be injected to a respective one of the chambers 110, 120, and 130 to inflate the chamber to a target pressure as discussed above. In some embodiments, each inflation source 510, 520, and 530 can include a liquid container coupled to a heater. The liquid containers can be described as having a pool of liquid associated with each container. The heater can be configured to heat the liquid in the container at a temperature that produces a vapor pressure equal or substantially equal to a target gas pressure for a designated chamber. The liquid in the liquid container can be water, alcohol or other liquid that exhibits a suitable temperature-vapor pressure relationship, e.g., in space or other environments in which the antenna is deployed. An advantage of the aforementioned inflation source can include low size, weight, complexity, and an ability to produce low gas pressures (e.g., approximately 101.7 kPa and lower), which may be desirable or necessary for large inflatable chambers such as the primary reflector chamber 110. Alternatively or additionally, in some embodiments, the inflation gas can be generated by heating one or more sublimation powders.

In some embodiments, an inner surface of one or more of the primary reflector chamber 110, the secondary reflector chamber 120, and the torus chamber 130 can be coated with an additional RF transparent material layer that hardens or cures when exposed to ultraviolet (UV) light from the sun. After hardening, the RF transparent material layer can form a closed shell that conforms to the inner shape of at least one of the inflated chambers (e.g., 110, 120, 130), thereby avoiding the need to continually pressurize the chambers using the inflation sources 510, 520, and 530. In some embodiments, the UV curable, RF transparent material layer can include an acrylate, such as but not limited to, various kinds of acrylates commercially available from companies such as BASF® having its headquarters in Florham Park, N.J.; Sigma-Aldrich® having its headquarters in St. Louis, Mo.; and Soltech Ltd. having its headquarters in Korea.

In some embodiments, the RF antenna feed 128 of the inflatable antenna 100 can include a phased array RF antenna feed configured to correct errors in RF signal transmission or reception due to reflector surface distortions and alignment errors. For example, in some embodiments, a processor can be configured to detect an RF signal error received by the phased antenna array feed from the second parabolic reflector of the inflatable antenna and correct the RF signal error by adjusting one or more analog or digital phase-shift weights of the phased antenna array feed.

In some embodiments, the inflatable antenna 100 can be configured with one or more mechanisms for facilitating confocal alignment of the primary and secondary parabolic reflectors. In other words, the focal point of the primary reflector and the focal point of the secondary reflector can be located at the same, or substantially same, point in space. Errors in confocal alignment can be due to deviations in the shape of the primary and/or secondary reflectors, behavior of the RF feed, or other factors. For example, in some embodiments, the height of the secondary reflector chamber 120 and/or the angular orientation of the primary reflector chamber 110 can be adjusted to confocally align the focal point of the secondary reflector 126 with the focal point of the primary reflector 116. Some non-limiting exemplary embodiments of ways by which the antenna 100 can be configured to improve confocal alignment are provided below with respect to FIGS. 6A-6C and 7A-7D.

Figure 6A:
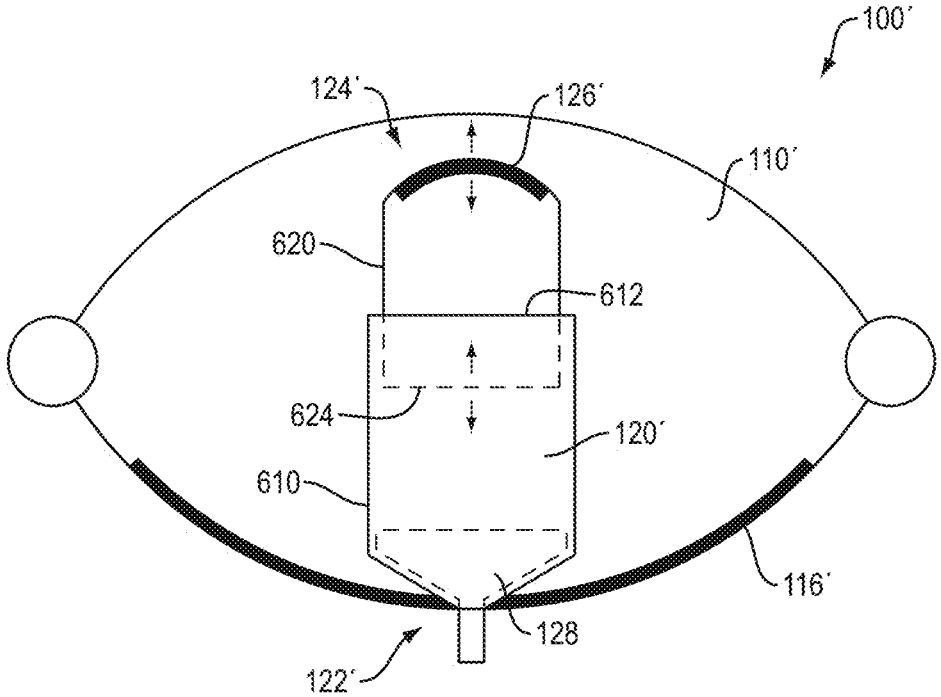
FIG. 6A is a schematic side view of another exemplary embodiment of an inflatable antenna, the antenna including a secondary reflector chamber that has an adjustable height.
Figure 6B:
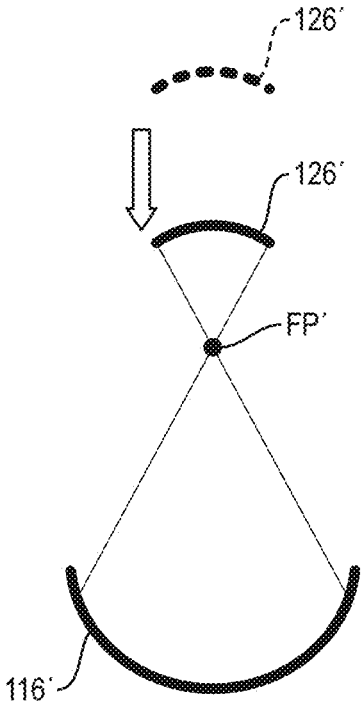
FIGS. 6B and 6C are schematic illustrations showing exemplary height adjustments of the secondary reflector chamber of FIG. 6A.
Figure 6C:
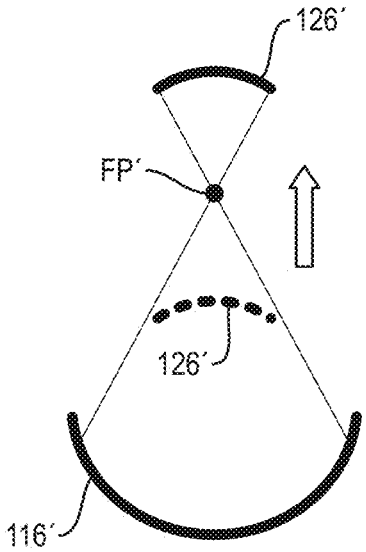

FIGS. 6A-6C illustrate a modified version of the inflatable antenna 100 of FIGS. 1A and 1B, the modified antenna 100' including a secondary reflector chamber 120' having an adjustable height. Similar to the secondary reflector chamber 120 of the antenna 100 of FIGS. 1A and 1B, the secondary reflector chamber 120' can be configured to form a substantially cylindrical tube having a first closed end 122' coupled to a primary reflector chamber 110' and a second closed end 124' having a paraboloid shape to form a secondary reflector 126'. In some embodiments, to make the height of the secondary reflector chamber 120' adjustable, the chamber can be manufactured in two or more telescoping parts, e.g., a base portion 610 and a head portion 620.

As shown in the illustrated embodiment of FIG. 6A, the base portion 610 of the chamber 120' can be configured to form a first part of the substantially cylindrical tube that includes the first closed end 122' and has an open end 612. The head portion 620 of the chamber 120' can be configured to form a second part of the cylindrical tube that includes the second closed end 124' and has an open end 624. Prior to inflation, the secondary reflector chamber 120' can be configured to have a target height when inflated by telescoping or otherwise translating the head portion 620 in and/or out of the open end 612 of the base portion 610. In some embodiments, the secondary reflector 126' can be raised or lowered into confocal alignment with the primary reflector 116' by adjusting the target height of the chamber 120' as discussed above.

For example, to lower the secondary reflector 126' into confocal alignment with the primary reflector 116' approximately at the focal point FP' as shown in FIG. 6B, the head portion 620 of the secondary reflector chamber 120' can be at least partially lowered into the base portion 610. Conversely, to raise the secondary reflector 126' into confocal alignment with the primary reflector 116' approximately at the focal point FP' as shown in FIG. 6C, the head portion 620 of the secondary reflector chamber 120' can be at least partially raised out of the base portion 610. Once configured, the head portion 620 can be adhered or otherwise joined to the base portion 610 so that the chamber 120' can be inflated to the target height during deployment.

Figure 7A:
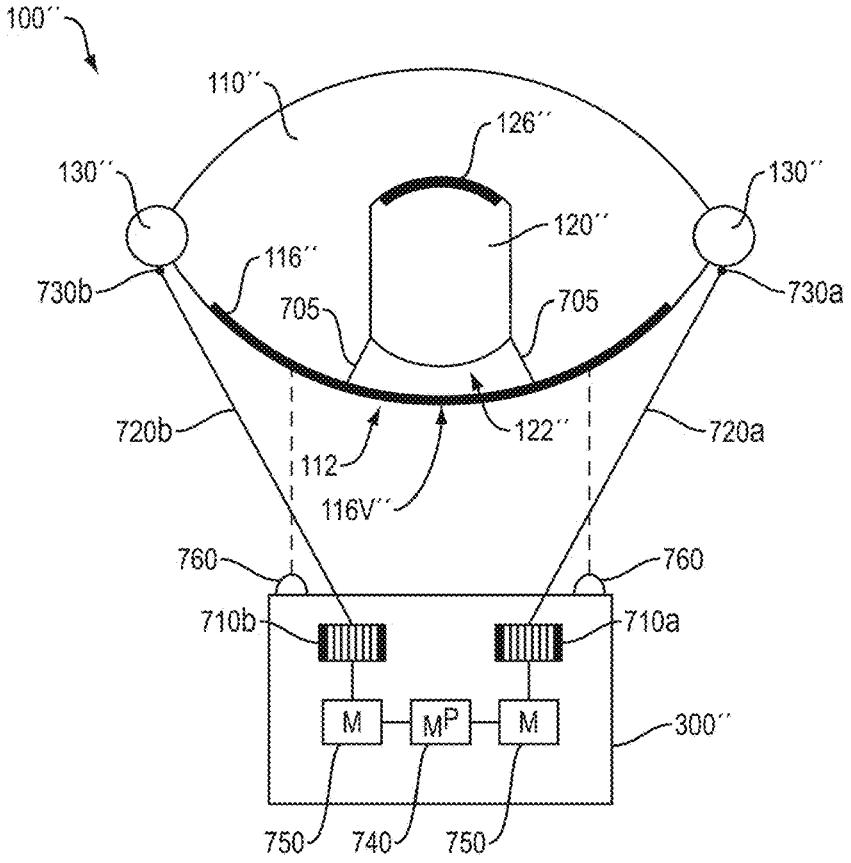
FIG. 7A is a schematic side view of yet another exemplary embodiment of an inflatable antenna, the antenna including a mechanism for adjusting an angular orientation of a primary reflector chamber of the inflatable antenna.
Figure 7B:
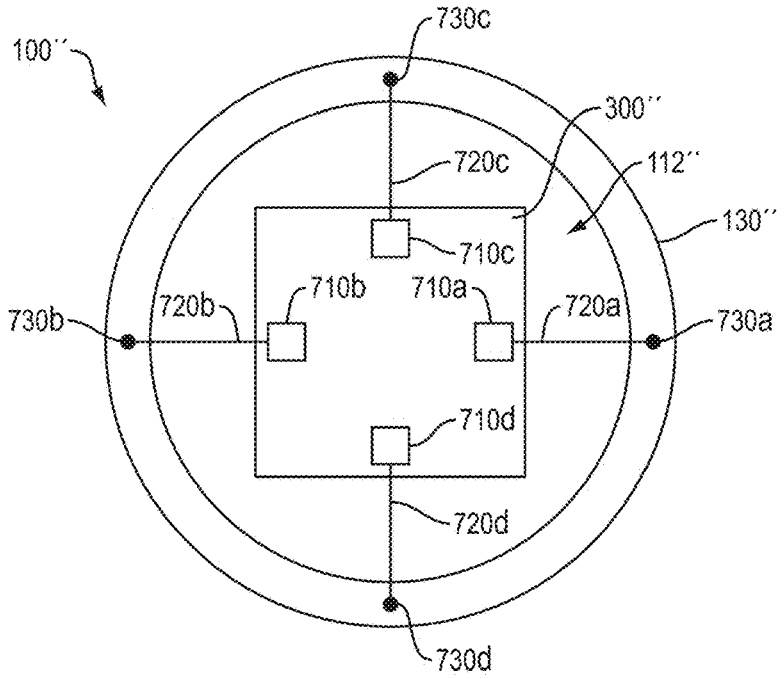
FIG. 7B is a schematic bottom view of the mechanism for adjusting an angular orientation of a primary reflect chamber of FIG. 7A.
Figure 7C:
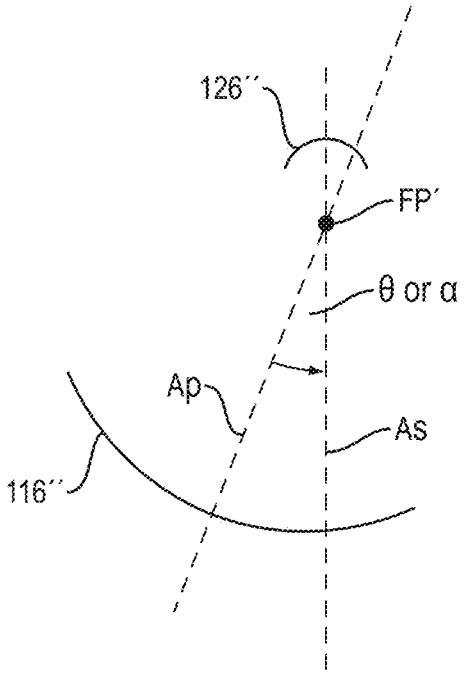
FIGS. 7C and 7D are schematic illustrations showing exemplary angular adjustments of the primary reflector chamber of FIG. 7A.
Figure 7D:
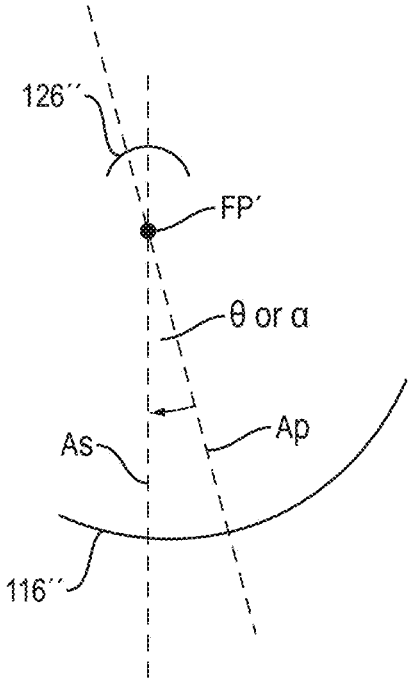

FIGS. 7A-7D are schematic illustrations of an exemplary embodiment of a mechanism for adjusting an angular orientation of a primary reflector chamber 110" of the an inflatable antenna 100", the antenna 100" being similar to the antenna 100 of FIGS. 1A and 1B. In some embodiments, when the inflatable antenna 100" is released and deployed in space from storage of a satellite 300" or other spacecraft body, the primary reflector chamber 110" can be tilted independent of a secondary reflector chamber 120", such that the focal axis of the primary reflector 116" can be coaxially aligned with the focal axis of the secondary reflector 126". For example, as shown in FIGS. 7C and 7D, the primary reflector chamber 110 can be tilted to counter an angular deviation in one or more of an elevation angle θ and azimuth angle α between the focal axis $A_p$ of the primary reflector 116" and the focal axis $A_s$ of the secondary reflector 126".

To allow the primary reflector chamber 110" to be tilted independent of the secondary reflector chamber 120", the secondary reflector chamber 120" can be loosely coupled to the primary reflector chamber 110". As shown in the illustrated embodiment of FIG. 7A, the secondary reflector chamber 120" can be loosely coupled to the primary reflector chamber 110" by attaching a first closed end 122" of the secondary reflector chamber 120" to a mechanical joint 705 disposed at or near the vertex 116V" of the primary reflector 116". For example, the mechanical joint 705 can be formed by adhering the first closed end 122" of the secondary reflector chamber 120" to a reflector side 112" of the primary reflector chamber 110" such that angular movements of the primary reflector chamber 110" causes minimal movement of the secondary reflector chamber 120". One of ordinary skill in the art will recognize that the secondary reflector chamber 120" can be loosely coupled to the primary reflector chamber 110" by employing other types of mechanical joints 705 capable of providing gimbal-type functionality.

To adjust the angular orientation of the primary reflector chamber 110", a torus chamber 130" of the antenna 100" can be coupled by wires or cables to an angular adjustment mechanism housed within the body of the satellite 300". As shown in the illustrated embodiment of FIGS. 7A and 7B, the angular adjustment mechanism can include two or more winches 710*a*, 710*b*, 710*c*, and 710*d* (individually or collectively 710) coupled by respective wires or cables 720*a*, 720*b*, 720*c*, and 720*d* (individually or collectively 720) to corresponding locations 730*a*, 730*b*, 730*c*, 730*d* (individually or collectively 730) on the torus chamber 130". For example, in some embodiments, the winches 710*a* and 710*b* can be connected to diametrically opposed locations 730*a* and 730*b* on the torus chamber 130" by cables 720*a* and 720*b*. The winches can be controlled to wind up or wind out a length of cable coupled to the torus chamber 130", thereby tilting the primary reflector chamber 110" at an angle in an azimuth direction. Alternatively or in addition, the winches 710*c* and 710*d* can be connected diametrically opposed locations 730*c* and 730*d* on the torus chamber 130" to tilt the chamber 110" at an angle in an elevation direction.

To control the tilt angle of the primary reflector chamber 110", a processor 740 can be configured to control one or more motors 750 that drive the winches 710 to draw in or let out a length of cable 720. In some embodiments, the processor 740 can be configured to control the motors 750 and thereby drive the winches based on the output of one or more optical sensors 760. For example, in some embodiments, the optical sensors 760 can be disposed on the satellite 300" such that the sensors face different points on the reflector surface of the primary reflector 116". The optical sensors 760 can be configured to emit light onto the reflective surface of the primary reflector 116" and output respective signals indicative of an intensity, phase and/or frequency of backscattered light from the primary reflector. The processor 740 can be configured to correlate the output of the optical sensors 760 (e.g., one or more of the intensity, phase, or frequency of the backscattered light) into one or more distance values indicative of a separation between the sensors 760 and the reflective surface of the primary reflector 116". The distance values can be used to determine an approximate tilt angle of the primary reflector 116" in one or more of azimuth and elevation directions. One of ordinary skill in the art will recognize other ways by which the tilt angle of the primary reflector 116" can be adjusted without departing from the spirit of the present disclosure.

Although four winches 710 are described above for adjusting the angular orientation of the primary reflector chamber 110" in azimuth and elevation directions, one of ordinary skill in the art will recognize that more or less than four winches can be used to make such adjustments. Furthermore, one of ordinary skill in the art will also recognize that in some embodiments, the cables 720 can be coupled directly to the primary reflector chamber 110" alternatively or in addition to being coupled to the torus chamber 130".

Figure 8A:
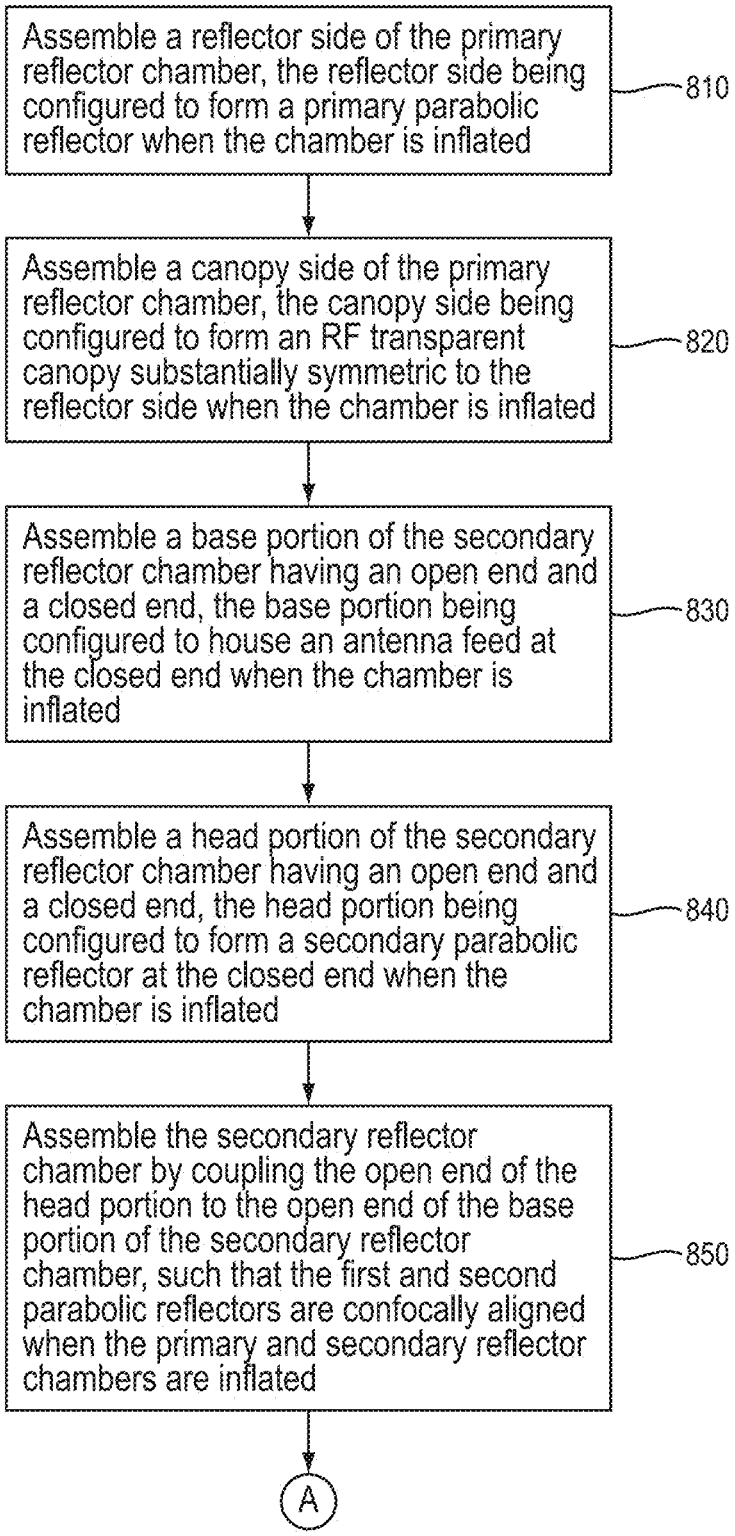
FIGS. 8A and 8B illustrate an exemplary embodiment of a method of manufacturing the inflatable antenna of FIGS. 1A and 1B.
Figure 8B:
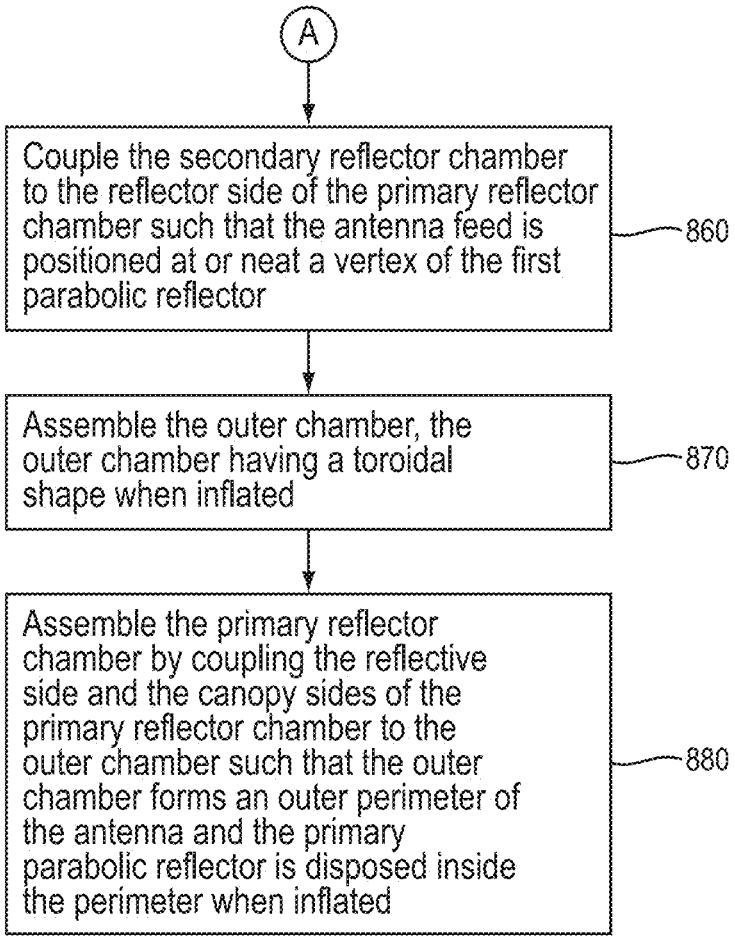

FIGS. 8A and 8B are flow diagrams that illustrate an exemplary embodiment of a method of manufacturing the inflatable antenna 100 of FIGS. 1A and 1B.

At block 810, the reflector side 112 of the primary reflector chamber 110 can be assembled. As provided, in some embodiments the reflector side 112 of the chamber 110 can be configured to form a primary parabolic reflector 116 when the chamber is inflated. At block 820, a canopy side 114 of the primary reflector chamber 110 can be assembled. As provided, in some embodiments the canopy side 114 of the chamber 110 can be configured to form an RF transparent canopy. The RF transparent canopy can be configured to be substantially symmetric to the reflector side 112 when the chamber 110 is inflated.

At block 830, a base portion 610 of a secondary reflector chamber 120 can be assembled. The base portion 610 can have an open end 622 and a closed end 122. The base portion 610 can be configured to house an antenna feed 128 at the closed end 122 when the chamber is inflated. At block 840, a head portion 620 of the secondary reflector chamber can be assembled. The head portion 620 can have an open end 624 and a closed end 124. The head portion 620 of the chamber can be configured to form a secondary parabolic reflector 126 at the closed end 124 when the chamber is inflated. At block 850, the secondary reflector chamber can be assembled by coupling the open end 622 of the base portion 610 to the open end 624 of the head portion 620 of the secondary reflector chamber. As provided, in some embodiments the primary and secondary reflectors 116, 126 are confocally aligned when the primary reflector chamber 110 and the secondary reflector chamber 120 are inflated.

At block 860, the secondary reflector chamber 120 can be coupled to the reflector side 112 of the primary inflatable chamber 110 such that the antenna feed 128 is positioned at or near a vertex of the primary parabolic reflector 116. At block 870, the outer chamber 130 can be assembled. In some embodiments, the outer chamber 130 can have a toroidal shape when inflated. At block 880, the primary reflector chamber 110 can be assembled by coupling the reflector side 112 and the canopy side 114 of the chamber to the outer chamber 130 such that the outer chamber forms an outer perimeter of the antenna and the primary parabolic reflector 116 is disposed inside the perimeter when inflated.

Figure 9A:
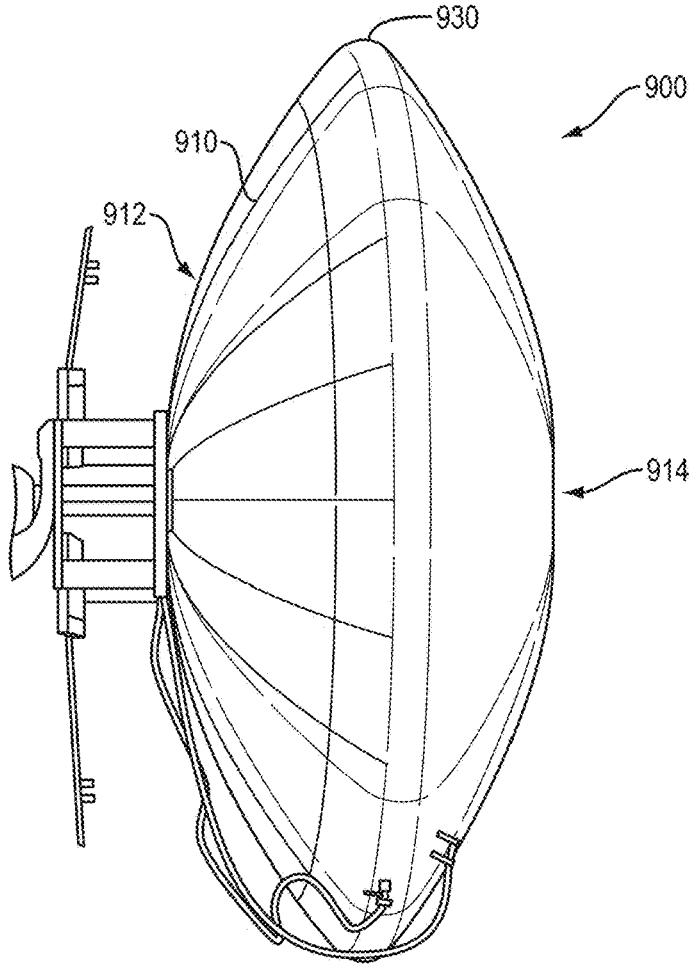
FIG. 9A illustrates a side view of a prototype of an exemplary embodiment of a primary reflector chamber and torus chamber for an inflatable antenna configured for operation in the X band.
Figure 9B:
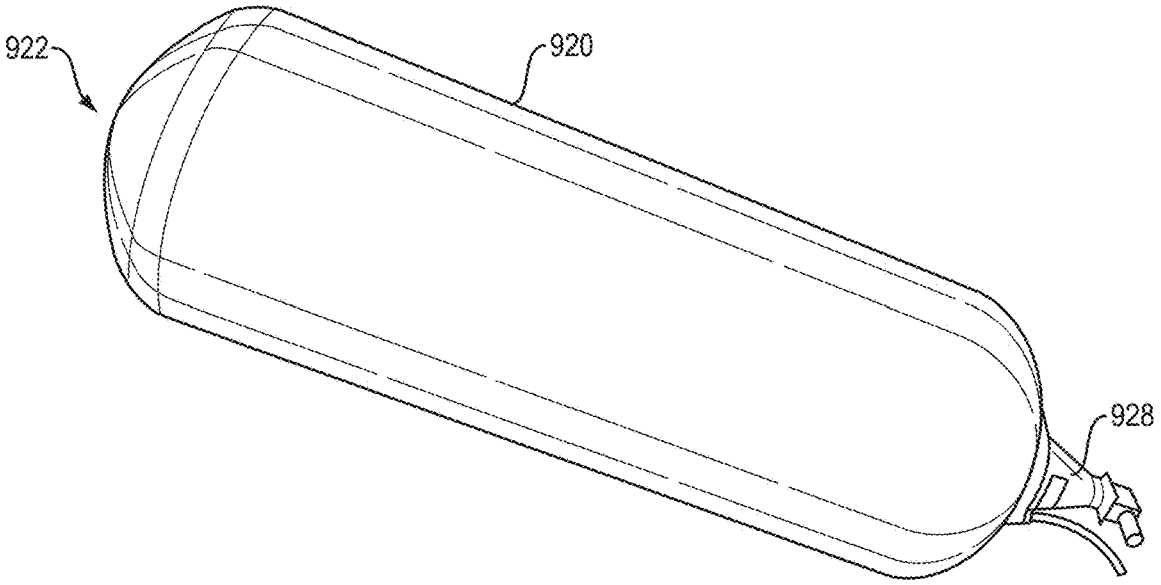
FIG. 9B illustrates a side view of a prototype of an exemplary embodiment of a secondary inflatable chamber for the inflatable antenna of FIG. 9A.

FIGS. 9A and 9B illustrate a prototype of an exemplary embodiment of an inflatable antenna 900 configured for operation in the X band (e.g., approximately in the range of about 8 GHz to about 12 GHz). As shown in the illustrated embodiment, the inflatable antenna 900 can be configured to form a Gregorian dual reflector antenna. To facilitate RF communications, radar, or other RF sensing in the X band, the inflatable antenna can include: (i) a primary reflector chamber 910 that can be inflated to form a primary reflector having a diameter of approximately 2.4 meters; (ii) a secondary reflector chamber 920 that can be inflated to form a secondary reflector having a diameter of approximately 0.25 meters; and (iii) a torus chamber 930 that can be inflated to form a toroid having a minor diameter of approximately 152.4 millimeters and an outer diameter of approximately 2.7 meters that defines the outer perimeter of the antenna 900.

In some embodiments, the reflector side 912 and the canopy side 914 of the primary reflector chamber 910, respectively, can be constructed by taping together twenty-four (24) sections, i.e., gores configured to form a paraboloid having a diameter of approximately 2.4 meters. In some embodiments, the edges of the gores can be taped together using a 25.4 millimeters wide, silicone pressure sensitive adhesive (silicone PSA) tape with a thickness of approximately 7.62 microns, such as from Kapton® HN carrier. In some embodiments, the individual gores for the reflector side 912 and the canopy side 914 can be arranged and taped on a three-dimensional taping mandrel, as provided for below or otherwise known to those skilled in the art. In some embodiments, such a mandrel can have a paraboloid shape, which can enhance the precision and accuracy of the RF reflective surface of the primary parabolic reflector (e.g., 116) having curvature in two dimensions.

In some embodiments, the canopy side 914 of the primary reflector chamber 910 can be made a bare Melinex® 377 polyester film having a thickness of approximately 25.4 microns that can be RF transparent through the Ku band. The reflector side 912 of the primary reflector chamber can be made of a bare Melinex® 377 polyester film having a thickness that can be approximately 25.4 microns. The RF reflective surface of the primary reflector can be a Vapor Deposited Aluminum (VDA) having a thickness of approximately 30 nanometers coated on the polyester film. As discussed above with respect to FIG. 4A, a portion of the RF transparent polyester film can be exposed in areas likely to develop wrinkles or other surface imperfections at the outer edge of the primary reflector.

The reflector side 922 of the secondary reflector chamber 920 can be constructed by taping together ten (10) sections, i.e., gores, configured to form a paraboloid having a diameter of approximately 0.25 meters. In some embodiments, the edges of the gores can be taped together using an approximately 12.7 millimeters wide, silicone PSA tape with a thickness of approximately 7.62 microns, such as from Kapton® HN carrier. In some embodiments, the individual gores for the reflector side 922 can be arranged and taped on a three-dimensional taping mandrel, as provided for below or otherwise known to those skilled in the art. In some embodiments, such a mandrel can have a paraboloid shape, which can enhance the precision and accuracy of the RF reflective surface of the secondary parabolic reflector (e.g., 126) having curvature in two dimensions.

In some embodiments, the reflector side 922 of the secondary reflector chamber 920 can be made of a bare Melinex® 377 polyester film having a thickness of approximately 25.4 microns that is coated with a Vapor Deposited Aluminum (VDA) having a thickness of approximately 30 nanometers to form the RF reflective surface of the second parabolic reflector (e.g., 126). As discussed above, a portion of the RF transparent polyester film can be exposed in areas likely to develop wrinkles or other surface imperfections at the outer edge of the primary reflector. In some embodiments, the secondary reflector chamber 920 including an RF antenna feed 928 can be installed at the base of the primary reflector of the primary reflector chamber 910 and taped using an approximately 25.4 millimeters wide Silicone PSA with a thickness of approximately 25.4 microns, such as from Kapton® HN carrier. The RF feed 928 can be integrated directly into the base of the secondary reflector chamber.

In some embodiments, the torus chamber 930 can be constructed by taping together twenty four (24) individual sections with each section including two individual gores. Each joint can be taped together using an approximately 25.4 millimeters wide, silicone PSA tape with a thickness of approximately 25.4 microns, such as from Kapton® HN carrier. The toroid can be made using a 50.8 microns thick Kapton® HN film.

In some embodiments, when the inflatable antenna is deployed, the primary reflector chamber 910 can be inflated to a pressure approximately equal to about 0.6 kilopascals (kPa), the secondary reflector chamber 920 can be inflated to a pressure approximately equal to about 2.6 kPa, and the torus chamber 930 can be inflated to a pressure approximately equal to about 20 kPa.

The inflatable antenna 900 can be folded to package the 2.4 meter Gregorian dual-reflector antenna within a stowed volume of a satellite or other spacecraft similar to solar sails. In some embodiments, the packed volume of the inflatable antenna 900 can be a function of the size of the antenna (e.g., total skin volume). For example, the packed volume of the inflatable antenna 900 can achieve a packing factor approximately in the range of about 2.5 to about 3 times larger than the total size volume of the antenna itself. In some embodiments, the inflatable antenna 900 can occupy a volume less than approximately 2 liters. In some embodiments, the inflatable antenna 900 configured to form a primary reflector having a 3 meter diameter can fit within a 2 U spatial volume. In some embodiments, the inflatable antenna 900 can be stowed within a volume that is approximately two (2) to three (3) orders of magnitude lower than in other mesh and inflatable antenna systems.

In some embodiments, surface distortions of the antenna due to temperature magnitude and gradient can be mitigated by using materials or films having a solar absorption to thermal emissivity ratio (a/c) that is less than one (1) and that exhibit high transmissivity in the solar band and moderate transmissivity in the thermal radiation band. The low a/c can keep overall peak temperature around room temperature or below while the high solar transmissivity can minimize gradients by ensuring direct solar, albedo, and earthshine radiation loads are equally distributed about the inflatable antenna. In some embodiments, coefficients of thermal expansion (CTE) induced surface distortion can be avoided or reduced using materials or films having a solar absorption to thermal emissivity ratio (a/c) less than approximately 0.5, a solar transmissivity greater than approximately 0.5, and a thermal emissivity at or about 0.8.

As discussed above, when the antenna is deployed, the chambers are inflated such that the RF reflective surfaces disposed within the chambers form the primary and secondary reflectors of the antenna having a substantially parabolic shape (i.e., a paraboloid). Thus, during manufacture of the antenna, it can be useful to inflate the respective chambers after assembly and observe the chambers for any surface distortions, including but not limited to the RF reflective surfaces of the primary and secondary reflectors. To the extent that surface distortions are detected, in some embodiments, the manufacturing process can include heating one or more portions of the primary reflector chamber and/or the secondary reflector chamber to remove such surface distortions. The application of heat at specific portions or regions of the primary and/or secondary reflector chambers at design pressure can cause thermal expansion due to permanent viscoelastic creep of the materials and/or films used to manufacture the chambers into the desired parabolic shape.

In some embodiments, the Gregorian dual-reflector antenna having a lens/horn feed can provide a measured gain of approximately 37.6 dBi with a 1° beamwidth at X band (10 GHz). This measured gain result compared closely to the theoretical peak directivity, which is approximately 41.4 dBi. In some embodiments, the inflatable antenna can be scaled to form a Gregorian dual reflector antenna having an aperture with a diameter approximately in the range of about 5 meters to about 10 meters to facilitate RF communications in the Ku band (e.g., 12 to 18 GHz). In some embodiments, the inflatable antenna can be scaled to apertures greater than about 10 meters for operation in higher frequency bands.

Figure 10A:
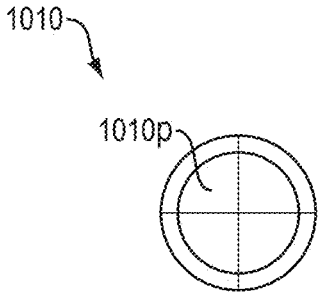
FIG. 10A is a top view of an exemplary embodiment of a three-dimensional (3D) taping mandrel for fabricating a secondary inflatable chamber of an inflatable antenna, like the secondary inflatable chamber of FIG. 9B.
Figure 10B:
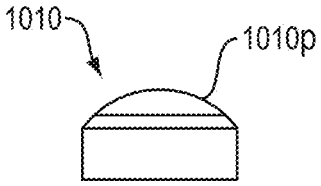
FIG. 10B is a side view of the 3D taping mandrel of FIG. 10A.

FIGS. 10A and 10B are illustrations showing top and side views of an exemplary embodiment of a three-dimensional (3D) taping mandrel 1010 for fabricating a reflector side 922 of the secondary reflector chamber 920. In some embodiments, the gores of the reflector side 922 can be arranged and taped on the 3D taping mandrel 1010 having curvature in two dimensions (i.e., azimuth and elevation). As shown in the illustrated embodiment, the proximal surface 1010*p* of the mandrel 1010 can be shaped to form the paraboloid for the secondary parabolic reflector (e.g., 126). In some embodiments, the 3D taping mandrel can be scaled to a size that facilitates arrangement and adhesion of the gores for the reflector side 912 and canopy side 914, respectively, of the primary reflector chamber 910. Although the individual gores can be adhered together using the mandrel 1010, one of ordinary skill in the art will recognize that other techniques for joining the gores together may be used, such as bonding, gluing, melting, etc.

Figure 11A:
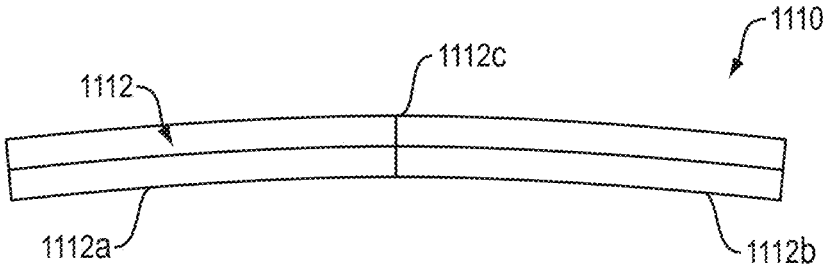
FIG. 11A is a top view of an exemplary embodiment of a 3D taping mandrel for fabricating a primary extension piece of an inflatable antenna.
Figure 11B:
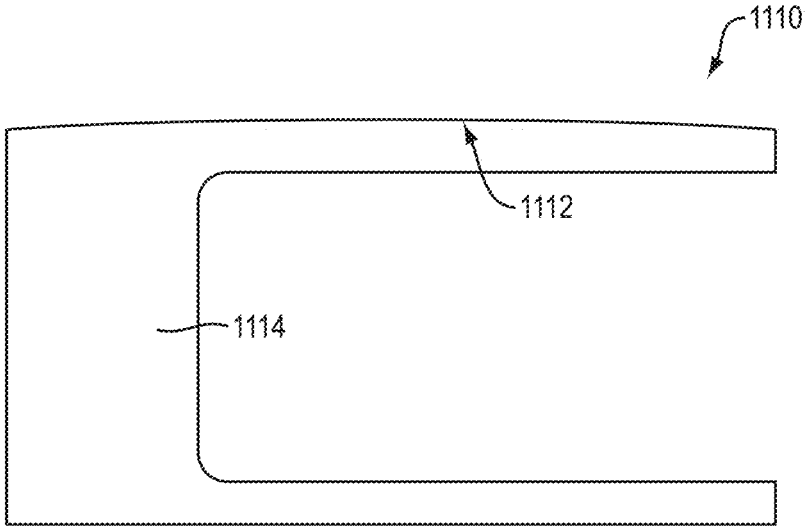
FIG. 11B is a side view of the 3D taping mandrel of FIG. 11A.

FIGS. 11A and 11B are illustrations showing top and side views, respectively, of an exemplary embodiment a 3D taping mandrel 1110 for taping or otherwise bonding a reflective extension piece (or gore) of the primary reflector side 912 to a corresponding non-reflective gore of the canopy side 914 of the inflatable antenna 900. In the illustrated embodiment, the 3D taping mandrel 1110 has non-planar taping surface 1112 on a support structure 1114. The non-planar taping surface 1112 can be configured to model the inflated shape or geometry of a connected pair of reflective and non-reflective gores when the antenna 900 is inflated. For example, in some embodiments, the 3D taping mandrel 1110 can model an overall curvature of the paraboloid at the outer edge of the antenna 900, as well as the expected curvature of the paraboloid surface of the antenna 900. During fabrication of the antenna 900, a gore of the reflector side 912 can be positioned on one side 1112*a* of the mandrel 1110 and a gore of the canopy side 914 can be positioned on the opposing side 1112*b*. The opposing edges of the reflective and non-reflective gores can be taped or otherwise bonded along the bonding line 1112*c* of the mandrel 1110. Thus, the mandrel 1110 can allow a taped bond line obtained during manufacture to be significantly closer to the geometry of the desired inflated bond line, thus reducing the risk of wrinkling when the antenna is inflated. In contrast, when a pair of reflective and non-reflective gores are taped on a two-dimensional (2D) mandrel having a flat surface, the taped bond may stretch during inflation, and thereby cause undesirable wrinkling along the taped bond line.

Although the various structures, mechanisms, and techniques disclosed herein are described in connection with the manufacture and deployment of a Gregorian dual reflector parabolic antenna, one of ordinary skill in the art will recognize that embodiments of such structures, mechanisms, and/or techniques can be tailored to manufacture and/or deploy other types of RF antenna and feed designs. One of ordinary skill in the art will recognize that the number of sections/gores, material or film selection, tape selection, material thicknesses, size, shape, and sectioning strategy, among other parameters, can be modified for different design intents and inflatable sizes.

The preceding description of the disclosed embodiments is provided to enable any person skilled in the art to make or use the claims. Various modifications to these embodiments will be readily apparent to those skilled in the art, and the generic principles defined herein may be applied to other embodiments without departing from the scope of the claims. Thus, the present disclosure is not intended to be limited to the embodiments shown herein but is to be accorded the widest scope consistent with the following claims and the principles and novel features disclosed herein.

What is claimed is:

1. An inflatable antenna, comprising:

a first inflatable chamber that includes a radio frequency (RF) reflective section configured to form a first reflector having a concave shape when the first inflatable chamber is inflated;

a second inflatable chamber disposed within the first inflatable chamber and including an RF reflective section configured to form a second reflector having one of a concave shape and a convex shape that opposes the first reflector when the second inflatable chamber is inflated; and a third inflatable chamber coupled to the first inflatable chamber and configured to define an outer perimeter of the inflatable antenna when the third inflatable chamber is inflated.

2. The inflatable antenna of claim 1, further comprising: an antenna feed disposed at an end of the second inflatable chamber at or near a base of the first reflector and configured to transmit or receive signals through the second reflector.

3. The inflatable antenna of claim 1, wherein the first inflatable chamber includes a first RF transparent section disposed around the RF reflective section to avoid surface distortions in the first reflector when the first inflatable chamber is inflated.

4. The inflatable antenna of claim 1, wherein the first inflatable chamber includes a second RF transparent section configured to form an RF transparent canopy that is substantially symmetric to the first reflector when the first inflatable chamber is inflated.

5. The inflatable antenna of claim 1, wherein the second inflatable chamber includes an RF transparent section disposed around the RF reflective section to avoid surface distortions in the second reflector when the second inflatable chamber is inflated.

6. The inflatable antenna of claim 1, wherein the first, second, and third inflatable chambers are configured to be separately inflated to different pressures selected to avoid surface distortions in the first reflector and the second reflector.

7. The inflatable antenna of claim 1, wherein the second reflector of the second inflatable chamber is configured to be confocally aligned with the first reflector of the first inflatable chamber to form a Gregorian dual-reflector antenna when the first and second inflatable chambers are inflated.

8. The inflatable antenna of claim 1, wherein the second inflatable chamber is configured to have an adjustable height to facilitate confocal alignment of the first reflector and the second reflector when the first and second inflatable chambers are inflated.

9. The inflatable antenna of claim 1, wherein an angular orientation of the first inflatable chamber is independently adjustable in one or more of an azimuth direction and an elevation direction to facilitate confocal alignment of the first reflector to the second reflector of the second inflatable chamber when the first and second inflatable chambers are inflated.

10. The inflatable antenna of claim 9, further comprising a winch having a plurality of cables coupled to the third inflatable chamber and configured to adjust the angular orientation of the first inflatable chamber in one or more of the azimuth direction and the elevation direction by respectively winding up or winding out the plurality of cables.

11. The inflatable antenna of claim 1, wherein each of the first reflector is configured to have one of a paraboloid shape, a spherical shape, or a custom shape when inflated and wherein the second reflector has one or more of a paraboloid shape, an ellipsoid shape, a hyperboloid shape, or a custom shape when inflated.

12. The inflatable antenna of claim 1, wherein one or more of the first, second, and third inflatable chambers are configured to be separately inflated such that a stress applied to each of the one or more inflatable chambers is at least about 10% of a yield point for a material of the chamber.

13. The inflatable antenna of claim 1, wherein the third inflatable chamber is configured to form a torus when inflated.

14. The inflatable antenna of claim 1, wherein the second inflatable chamber is configured to form a substantially cylindrical tube having a closed end portion that forms the second parabolic reflector when the second inflatable chamber is inflated.

15. The inflatable antenna of claim 1, wherein one or more of the first inflatable chamber, the second inflatable chamber, and the third inflatable chamber is made of a polyester material.

16. A method of using an inflatable antenna, comprising:

releasing an inflatable antenna having a plurality of inflatable chambers from a storage of a spacecraft body while in space; and inflating the plurality of inflatable chambers of the inflatable antenna to different pressures, wherein a first inflatable chamber having a radio frequency (RF) reflective section is inflated to a first pressure that causes the RF reflective surface to form a first reflector having a concave shape, wherein a second inflatable chamber having a RF reflective section and disposed within the first inflatable chamber is inflated to a second pressure that causes the RF reflective section to form a second reflector having one of a concave shape and a convex shape that opposes the first reflector, and wherein a third inflatable chamber is inflated to a third pressure that causes the third inflatable chamber to form an outer perimeter of the inflatable antenna.

17. The method of claim 16, wherein inflating the plurality of inflatable chambers of the inflatable antenna to different pressures comprises:

heating a liquid or solid source for each of the plurality of inflatable chambers to a respective temperature to generate an inflation gas; and injecting the inflation gas from each heated liquid or solid source into a respective one of the plurality of inflatable chambers to inflate the chamber to a target pressure.

18. A method of manufacturing an inflatable antenna, comprising:

assembling a first portion and a second portion of a first inflatable chamber, wherein the first portion includes a radio frequency (RF) reflective section configured to form a first parabolic reflector and the second portion includes an RF transparent section configured to form an RF transparent canopy that is substantially symmetric to the first parabolic reflector when the first inflatable chamber is inflated;

assembling a first portion and a second portion of a second inflatable chamber, wherein the first portion is configured to house an antenna feed and the second portion includes an RF reflective section configured to form a second parabolic reflector that opposes the first parabolic reflector when the second inflatable chamber is inflated;

assembling the second inflatable chamber by coupling the first portion and the second portion of the second inflatable chamber;

coupling the second inflatable chamber to the first portion of the first inflatable chamber such that the antenna feed is at or near a vertex of the first parabolic reflector;

assembling a third inflatable chamber having a toroidal shape; and assembling the first inflatable chamber by coupling the first portion and the second portion of the first inflatable chamber to the third inflatable chamber such that the third inflatable chamber forms an outer perimeter of the inflatable antenna and the first parabolic reflector and the RF transparent canopy are symmetrically disposed inside the perimeter when the first, second and third inflatable chambers are inflated.

19. The method of claim 18, further comprising:

inflating the first, second, and third inflatable chambers to different pressures to form the first parabolic reflector, the second parabolic reflector, and the outer perimeter of the inflatable antenna; and heating one or more portions of the first inflatable chamber to remove surface distortions in the first parabolic reflector.

20. The method of claim 18, further comprising:

inflating the second inflatable chamber to form the second parabolic reflector; and heating one or more portions of the second inflatable chamber to remove surface distortions in the second parabolic reflector.

* * * * *